United States Patent [19]

Langford

[11] 4,184,047

[45] Jan. 15, 1980

[54] AUDIO SIGNAL PROCESSING SYSTEM

[76] Inventor: Robert H. Langford, P.O. Box 9628, Atlanta, Ga. 30319

[21] Appl. No.: 809,145

[22] Filed: Jun. 22, 1977

[51] Int. Cl.[2] ..... G10H 1/02

[52] U.S. Cl. ..... 179/1 J

[58] Field of Search ..... 179/1 J, 15.55 T, 1 VL, 179/1 G; 84/1.24; 333/14 R

[56] References Cited

U.S. PATENT DOCUMENTS

| | | | |
|---|---|---|---|
| 3,959,597 | 4/1976 | Keiser | 179/15.55 T |
| 3,969,680 | 7/1976 | Wermuth | 333/14 |

OTHER PUBLICATIONS

L. Feldman, "Time Delay", Audio, Dec. 1976, p.44

*Primary Examiner*—Thomas W. Brown

*Attorney, Agent, or Firm*—Beveridge, De Grandi, Kline & Lunsford

[57] ABSTRACT

An audio signal processing system for enhancing audio signals such as music by providing reverberation, generation of stereophonic or quadraphonic effects, chorusing, flanging, pitch change, vibrato and various combinations of these effects. An audio signal is passed through a compressor, to increase its signal-to-noise ratio,and then through a delay circuit. The delayed audio signal is passed through an expandor to restore the original input level. Preferably, before being applied to the compressor the audio signal passes through a pre-emphasis circuit and, after passing through the expandor, through a de-emphasis circuit, thereby emphasizing desired frequencies. In some embodiments, the processed output signal is blended with the received audio signal to provide a blended audio signal, and in some embodiments the processed audio signal is fed back to the system input for recirculation, providing reverberation. The delay circuit is preferably an analog shift register.

12 Claims, 6 Drawing Figures

AUDIO SIGNAL PROCESSING SYSTEM

The present invention pertains to an audio signal processing system. More particularly, the present invention pertains to a system for processing audio signals such as high fidelity sound signals, for example, sound signals from a music source, to provide enhanced sound signals.

The present invention is particularly suited for enhancement of audio sounds such as musical sounds, including both instrumental and vocal musical sounds. The signal enhancement might include reverberation, generation of a stereophonic or quadraphonic effects, chorusing, flanging, pitch change vibrato and various combinations of these effects.

Numerous devices have been provided to enhance audio signals. Generally such devices are capable only of limited enhancement techniques such as vibrato, as shown in U.S. Pat. Nos. 3,878,472 and 3,945,290 or reverberation, as shown in U.S. Pat. Nos. 2,748,192, 2,852,604, 3,624,266, 3,816,637, 3,843,840, 3,939,436, and 3,939,437. While these various systems do somewhat enhance the audio signals, still each provides only one type of signal enhancement. Additionally, the fidelity of the signal is reduced in many of these systems. By way of example, the systems of U.S. Pat. Nos. 3,681,531 and 3,816,637 utilize digital storage of signals which necessitates first analog-to-digital conversion and then digital-to-analog conversion. Signal fidelity is reduced during such conversions. Likewise, the systems of U.S. Pat. Nos. 3,800,059 and 3,843,840 utilize electromechanical delay devices which do not permit reproduction of the signal fidelity.

The present invention is an audio signal processing system providing enhancement of audio signals in various manners without significant loss of signal fidelity. In accordance with the present invention, the audio signal is passed through a compression circuit, to increase its signal-to-noise ratio, and then is applied to a delay circuit. In a preferred embodiment of the present invention, the delay circuit comprises an analog shift register, which is a charge-coupled device having the ability to sample analog audio signals. The delayed audio signals from the shift register are passed through an expandor circuit to restore the original input level. Preferably, before being applied to the compression circuit, the audio signal passes through a pre-emphasis network to compensate for high frequency aperture loss and through a low pass filter. Likewise, preferably, the expandor circuit output is passed through a low pass filter, which assures that noise, possibly introduced by the analog shift register, is removed, and through a de-emphasis circuit. The processed output signal is blended with the original input signal to provide a blended output signal having desired characteristics. In some embodiments of the present invention, a portion of the processed output signal is returned to the system input for recirculation, thereby providing reverberation.

These and other aspects and advantages of the present invention are more apparent in the following detailed description and claims, particularly when considered in conjunction with the accompanying drawings in which like parts bear like reference numerals. In the drawings:

Figure 1:
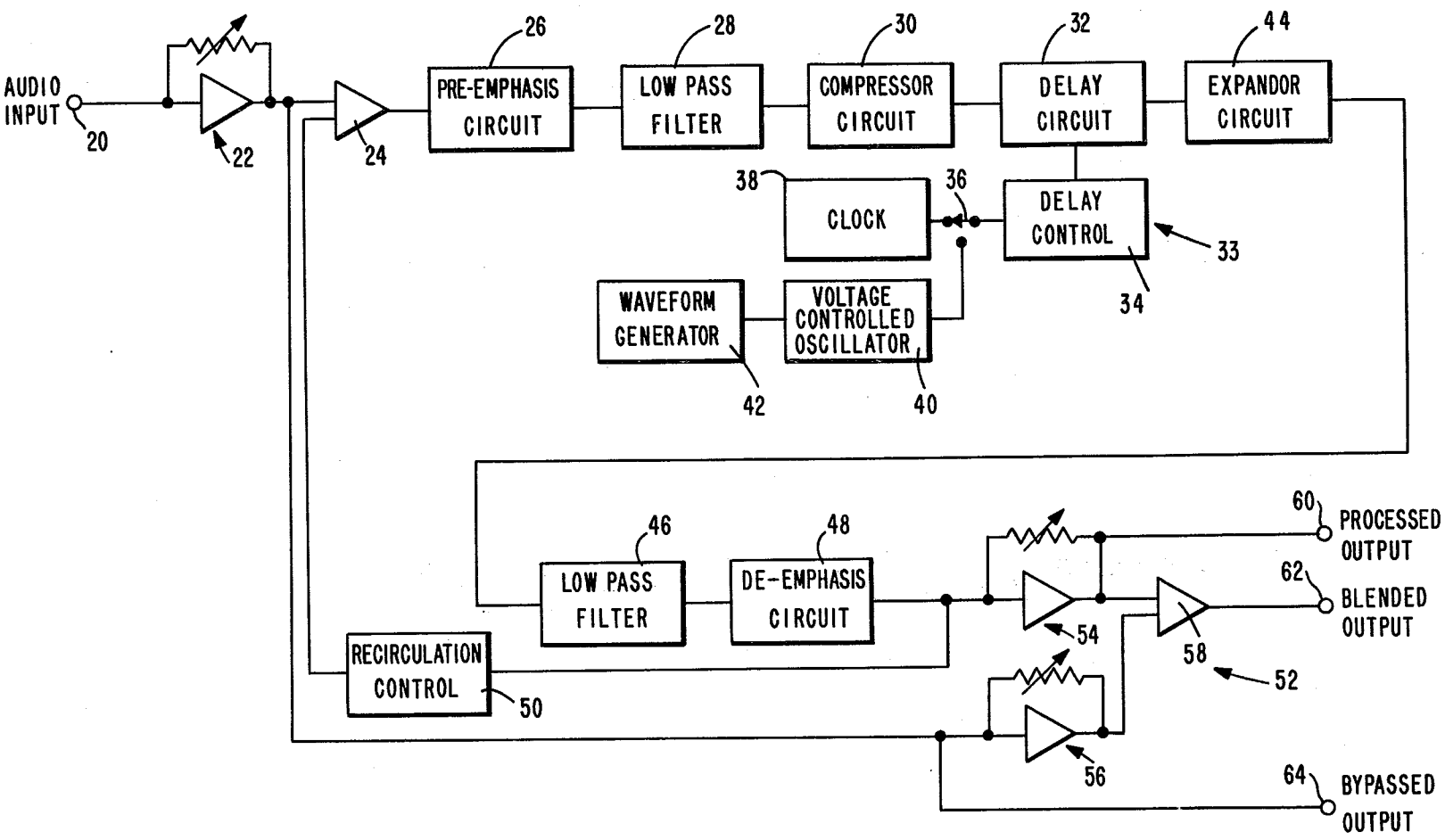
FIG. 1 is a block diagram depicting a preferred embodiment of an audio signal processing system in accordance with the present invention.

In the audio signal processing system depicted in FIG. 1, audio input signals, applied to input terminal 20, are passed through variable gain input amplifier 22 to one input of a summing circuit 24. Input amplifier 22 includes a gain control to provide the desired gain for the received audio input signal. From summing circuit 24 the audio signal is applied to pre-emphasis circuit 26 which emphasizes the desired signal frequencies. From pre-emphasis circuit 26 the audio signal is applied through low pass filter 28 to compressor circuit 30. The compressor circuit compresses the intensity range of the signals by amplifying weak signals and attenuating strong signals so as to produce a smaller amplitude range. The audio signals are applied from compressor circuit 30 to delay circuit 32 which delays the auido signals by an amount determined by delay timing circuitry 33. Delay timing circuitry 33 includes delay control 34 which has its output connected to delay circuit 32, to apply control signals thereto, and its input connected to the moving contact of switch 36. The first fixed contact of switch 36 is connected to clock 38 to receive regularly-occurring clock pulses therefrom, while the second fixed contact of switch 36 is connected to the output from voltage controlled oscillator 40 which has its input connected to the output of waveform generator 42. Thus, with switch 36 in its first position, delay control 34 receives regularly occurring clock pulses from clock 38, while in the second position of switch 36, delay control 34 receives pulses from voltage control oscillator 40 at intervals determined by waveform from generator 42. Waveform generator 42 might provide any desired waveform, for example, a regular square wave, as depicted in FIG. *2a*, a rectangular wave having a greater duration during one phase than during the other, as depicted in FIG. *2b*, an irregularly occurring rectangular wave, as depicted in FIG. *2c*, a sine wave, as in FIG. *2d*, a triangular wave, as in FIG. *2e*, a regular sawtooth wave, as in FIG. *2f*, a decaying sawtooth wave, as in FIG. *2g*, or a reverse sawtooth wave, either regular or decaying as in FIG. *2h*. The output frequency of voltage controlled oscillator 40 varies with the level of the voltage applied to it by waveform generator 42. Thus, the output from waveform generator 42 is preferably at a significantly lower frequency than is the output from voltage controlled oscillator 40, and with switch 36 in its second position, the delay caused by delay control 34 varies in a manner determined by the output from waveform generator 42, thereby permitting various special effects to be created in the audio processing system of the present invention.

The delayed audio signal is applied by circuit 32 to expandor circuit 44 which returns the compressed signal to its original form by attenuating weak signals and amplifying strong signals. The expanded audio signal is then passed through low pass filter 46 to de-emphasis circuit 48. Filter 46 assures that any noise introduced by delay circuit 32 is removed. De-emphasis circuit 48 restores substantially the original signal power distribution.

The processed audio signal from the output of de-emphasis circuit 48 is applied through recirculation control 50 to the second input of summing circuit 24. Accordingly, a portion of the processed output is recirculated through the system, providing a reverberation effect.

Blending network 52 includes a first variable gain amplifier 54, which receives at its input the output from de-emphasis network 48, a second variable gain amplifier 56, which receives at its input the unprocessed audio signal from the output of input amplifier 22, and summing circuit 58, which sums the outputs of amplifiers 54 and 56 to provide a blended output signal at system output terminal 62. In addition, the output of amplifier 54 is connected to system output terminal 60 to provide a processed audio output signal, not blended with the input audio signal, and the output of input amplifier 22 is connected to system output terminal 64 to provide a by-passed output signal. Accordingly, any of the three output signals is available; the processed output signal at output terminal 60, the blended output signal at terminal 62, and the by-passed output signal at terminal 64.

The input signals received at terminal 20 and applied through amplifier 22 and summing circuit 24 contain a wide spectrum of frequencies. Pre-emphasis circuit 26 emphasizes those frequencies which are desired in the audio signal. Likewise, de-emphasis circuit 48 restores the original signal power distribution. The use of pre-emphasis and de-emphasis circuits is discussed, for example, in the treatise *Reference Data for Radio Engineers,* Fifth Edition, McGraw-Hill, at pages 21-11 and 21-12.

Compressor circuit 30 amplifies weak signals and attenuates strong signals so as to produce a smaller signal amplitude range. As a consequence, delay circuit 32 more readily accommodates the signal range. Expandor circuit 44 returns the compressed signals to their original form by attenuating weak signals and amplifying strong signals. By way of example, compressor circuit 30 and expandor circuit 44 might be a dual analog compandor available from Signetics Corporation of Sunnyvale, Calif. as its NE570/571 compandor.

Figure 3:
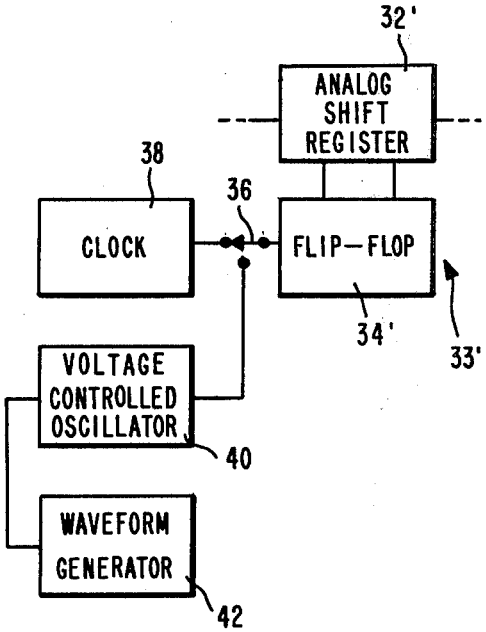
FIG. 3 is a fragmentary block diagram depicting a preferred embodiment of delay effects circuitry suitable for incorporation into the audio signal processing system of the present invention.

Delay circuit 32 is preferably an analog delay device such as Reticon SAD-1024, manufactured by Reticon Corporation of Sunnyvale, Calif. This is a bucket brigade clocked analog delay line which utilizes N-channel MOS technology. FIG. 3 depicts a preferred form of the delay circuitry suitable for the audio signal processing system of the present invention. Analog shift register 32' receives clock inputs from delay timing circuitry 33' which includes bistable multivibrator or flip-flop 34' driven alternatively by clock 38 or by voltage control oscillator 40 under the control of waveform generator 42, depending upon the position of switch 36. Low pass filter 28 removes signals of a frequency too high for processing by the delay circuitry. Filter 28 passes frequencies below about one-half the flip-flop frequency, thereby preventing the input to analog shift register 32' from being of so high a frequency that it cannot properly be sampled or processed. Typically, clock 38 might have a frequency in the range of from about 40 KHz to about 125 MHz. Low pass filter 46 passes signals of a frequency below the clock frequency, assuring that the clock signal is not heard in the processed output.

Figure 2:
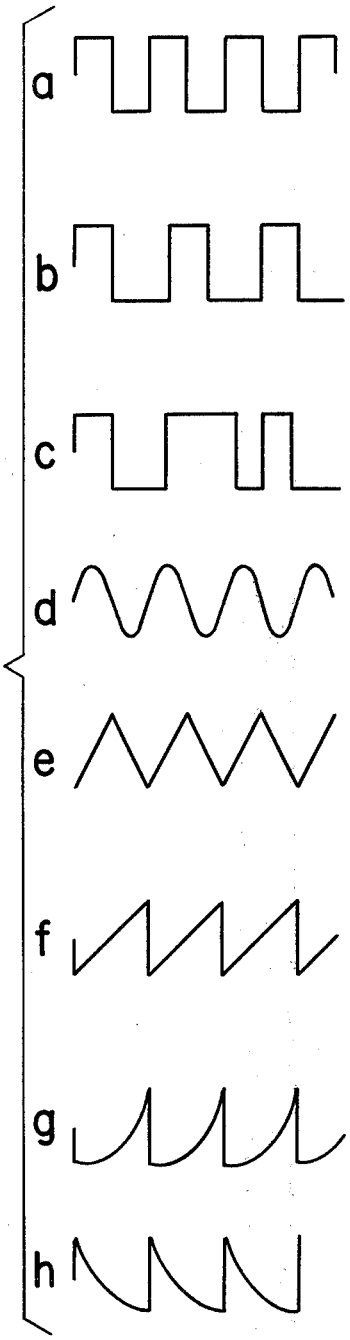
FIG. 2 depicts alternative wave forms which might be utilized to control the delay effects introduced by the system of the present invention.

Delay circuit 32' under the control of delay timing circuitry 33' has the ability to delay the audio signal over a variable delay range of from abouut 0.2 milliseconds to about 200 milliseconds, or perhaps greater. Recirculation of the processed output through recirculation control 50 to summing amplifier 24 provides reverberation. Short delay intervals, under about 10 milliseconds, result in loudness enhancement, since the human ear cannot detect a delay of only 10 milliseconds. Doubling can be achieved by utilizing a delay in the order of 20 to 40 milliseconds. Long and short echoes can be provided with the delays in the order of from about 50 milliseconds to about 200 milliseconds. Phasing can be achieved by blending the input with a processed output having less than about 1 millisecond delay. The output phase can be inverted with relation to the input signal to prevent audio cancellation. Flanging of the audio signals can be accomplished in a somewhat similar manner. By varying the delay, nulls can be provided in the signal at one-half the sampling frequency, thereby giving the effect of passing the audio signal through a comb filter. Comb filter effects cancel audio signals as the delay is shifted. Vibrato can be achieved by applying the sinesoidal waveform of FIG. **2*d* from generator 42 to voltage control oscillator 40 with switch 36 in its second position. Various special effects can be achieved by providing the various waveforms of FIG. 2 from waveform generator 42 to voltage controlled oscillator 40. If waveform generator 42 provides the square wave of FIG. 2*a*, even harmonics are introduced into the processed output signal. If waveform generator 42 provides the triangular wave of FIG. 2e l odd harmonics are introduced. Accordingly, it is seen that numerous special effects can be created utilizing the audio signal processing system of FIG. 1**.

In accordance with the present invention, a stereophonic effect can be created by utilizing two of the outputs of the audio processing system simultaneously. Thus, in the system as depicted in FIG. 1, a monaural audio signal can be applied to input terminal 20, and a stereo effect can be obtained by the simultaneous use of the by-passed output from output terminal 64 and the processed output from terminal 60. In the application of the audio signal processing system of the present invention to provide a stereophonic signal, the controls on the amplifiers 54 and 56, with blend control circuitry 52, might be combined or ganged into a single control knob, if desired.

Figure 4:
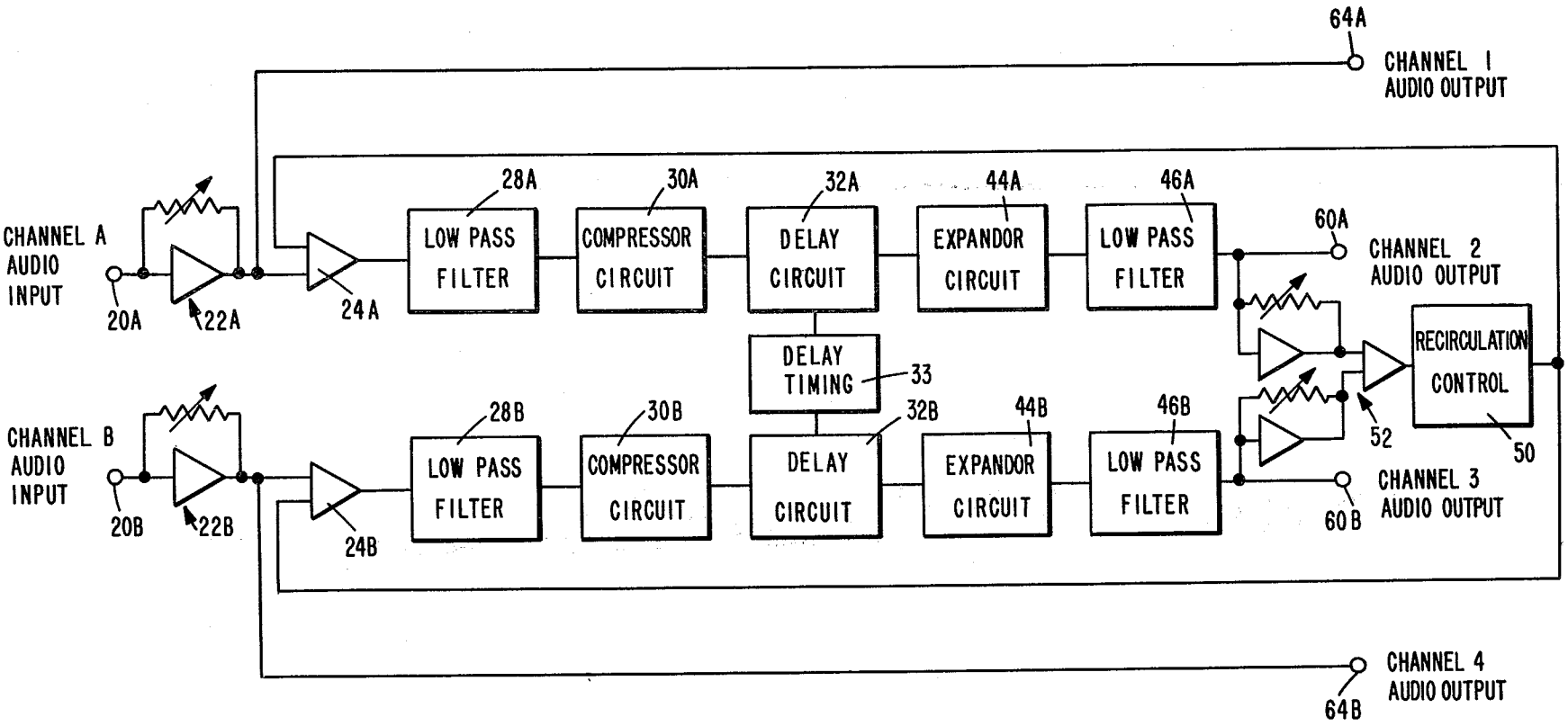
FIG. 4 is a block diagram of an audio signal processing system in accordance with the present invention and suitable for providing quadraphonic output signals from stereophonic input signals.

FIG. 4 depicts an audio signal processing system in accordance with the present invention suitable for providing a quadraphonic output from a stereophonic input. Input terminals 20A and 20B receive respectively the channel A audio input and the channel B audio input. Each input 20A, 20B applies its received audio input signal to a variable gain amplifier 22A, 22B the output of which is connected to one input of a summing circuit 24A, 24B. The summing circuits pass their outputs through low pass filters 28A, 28B, respectively, to compressor circuits 30A, 30B. The compressor circuits 30A, 30B outputs are applied respectively to delay circuits 32A, 32B. Each delay circuit 32A, 32B is under the control of common delay timing circuitry 33. Delay circuits 32A, 32B have the outputs applied respectively to expandor circuits 44A, 44B, the outputs of which are applied to low pass filters 46A, 46B. If desired, pre-emphasis circuits and de-emphasis circuits can be incorporated, as in the embodiment of FIG. 1. The outputs of the two low pass filters 46A, 46B are applied through blending network 52 to recirculation control 50, the output of which is applied to the second input of each of the summing circuits 24A, 24B. Output terminal 64A is connected to the output of input amplifier 22A to provide the channel A by-pass signal as a channel 1 audio output signal. The output of low pass filter 46A is connected to output terminal 60A to provide the processed channel A signal as the channel 2 audio output signal. In like manner, the output of low pass filter 46B is connected to output terminal 60B to provide the processed channel B signal as the channel 3 audio output signal. Output terminal 64B is connected to the output of input amplifier 22B to provide the channel B by-pass signal as the channel 4 output signal.

Figure 5:
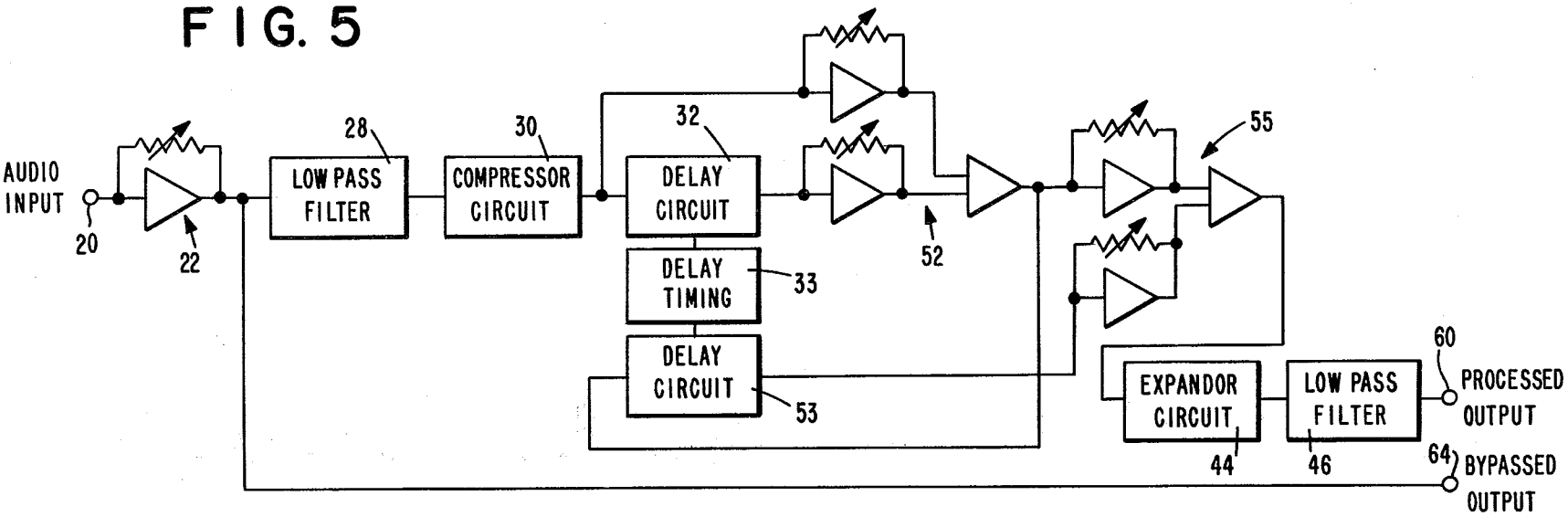
FIGS. 5 and 6 are block diagrams of further embodiments of an audio signal processing system in accordance with the present invention.

FIG. 5 depicts another audio signal processing system in accordance with the present invention. The audio input signals applied to input terminal 20 pass through variable gain amplifier 22, low pass filter 28, compressor circuit 30, and delay circuit 32 to blending network 52 which also receives the compressed audio signals from the output of compressor circuit 30. The output of blending network 52 is applied to delay circuit 53 which is under the control of delay timing circuitry 33, just as is delay circuit 32. The output of delay circuit 53 is applied to one input of blending network 55 which receives at its second input the output of blending network 52. The output of blending network 55 is applied through expandor circuit 44 and low pass filter 46 to output terminal 60 to provide the processed output signal. Output terminal 64 is connected to the output of input amplifier 22 to provide the by-passed audio output signal. If desired, a further expandor, low pass filter and output terminal could be connected to the output of blending network 52 to provide another output audio signal.

Figure 6:
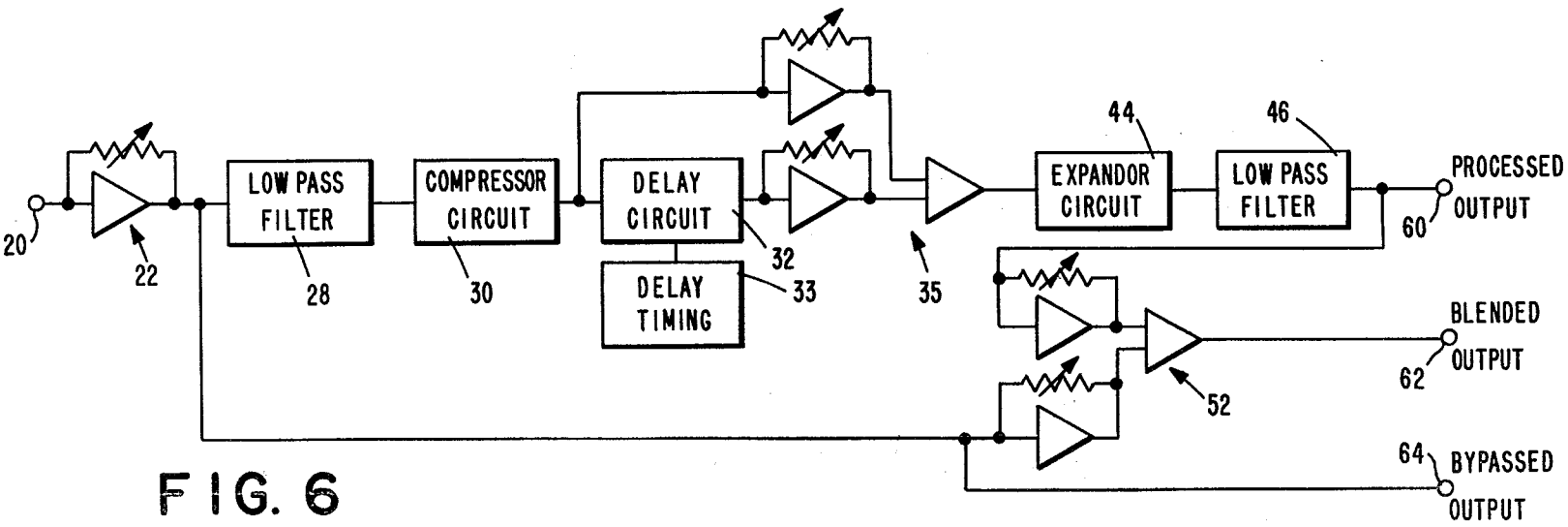

FIG. 6 depicts a further embodiment of audio signal processing system in accordance with the present invention. The audio input signals from input terminal 20 pass through variable gain amplifier 22, low pass filter 28, and compressor circuit 30 to delay circuit 32 which is under the control of delay timing circuit 33. Blending network 35 receives as inputs the delayed audio signal from delay circuit 32 and the compressed audio signal from the output of compressor circuit 30. The output of blending network 35 is applied through expandor circuit 44 and and low pass filter 46 to output terminal 60 to provide the processed audio output signal. Blending network 52 receives as inputs the processed audio signal from low pass filter 46 and the received audio signal from the output of input amplifier 22. The output of blending network 52 is connected to output terminal 62 to provide a blending output audio signal. Output terminal 64 is connected to the output of input amplifier 22 to provide the by-passed audio output signal.

An audio signal processing system in accordance with the present invention and capable of providing vibrato might be formed utilizing the circuitry of FIG. 1 without blending network 52, blended audio output terminal 62, recirculation control 50, and summing circuit 24. By providing by-passed audio output terminal 64, such a system could be utilized to convert a monaural input to a stereo input. Likewise, by providing a switch between expandor 44 and processed audio output terminal 60 and providing a monitor such as earphones at by-passed audio output terminal 64, such a system could be utilized as an audio signal censoring system.

The several forms of audio signal processing system in accordance with the present invention permit obtaining numerous special effects in audio signals. Various modifications of the circuitry might be incorporated in accordance with the present invention; for example, the blending networks 35, 52, and 55 might be simple resistive networks rather than including amplifiers. Thus, although the invention has been described with reference to the preferred embodiments, numerous alterations and rearrangements could be made and still the result would be within the scope of the invention.

What is claimed is:

1. An audio signal processing system comprising:
input means for receiving an audio signal;
a compressor coupled to said input means for compressing the received audio signal;
time delay means coupled to said compressor for delaying the compressed audio signal;
an expandor coupled to said time delay means for expanding the delayed audio signal;
output means for providing a processed output signal from said system; and
signal blending means coupled to said time delay means and to said compressor for blending the delayed audio signal with the compressed audio signal to provide a blended audio signal.

2. An audio signal processing system as claimed in claim 1 further comprising recirculation means for applying a portion of the expanded audio signal to the compressor for recirculation with the received audio signal.

3. An audio signal processing system as claimed in claim 2 further comprising a pre-emphasis circuit coupling said input means to said compressor for emphasizing selected signal frequencies and a de-emphasis circuit coupling said expandor to said output means for restoring substantially the original signal power distribution.

4. An audio signal processing system as claimed in claim 3 further comprising a first low pass filter coupling said input means to said compressor for filtering out signals of a frequency above a first selected frequency, and a second low pass filter coupling said expandor to said output means for filtering out signals of a frequency above a second selected frequency.

5. An audio signal processing system as claimed in claim 2 further comprising a first low pass filter coupling said input means to said compressor for filtering out signals of a frequency above a first selected frequency, and a second low pass filter coupling said expandor to said output means for filtering out signals of a frequency above a second selected frequency.

6. An audio signal processing system as claimed in claim 1 further comprising a first low pass filter coupling said input means to said compressor for filtering out signals of a frequency above a first selected frequency, and a second low pass filter coupling said expandor to said output means for filtering out signals of a frequency above a second selected frequency.

7. An audio signal processing system as claimed in claim 1 further comprising a pre-emphasis circuit coupling said input means to said compressor for emphasizing selected signal frequencies and a de-emphasis circuit coupling said expandor to said output means for restoring substantially the original signal power distribution.

8. An audio signal processing system as claimed in claim 7 further comprising a first low pass filter coupling said input means to said compressor for filtering out signals of a frequency above a first selected frequency, and a second low pass filter coupling said expandor to said output means for filtering out signals of a frequency above a second selected frequency.

9. An audio signal processing system as claimed in claim 1 further comprising:

second time delay means coupled to said signal blending means for further delaying the blended audio signal; and second signal blending means coupling said first blending means and said second time delay means with said expandor for blending the blended audio signal with the further delayed audio signal.

10. An audio signal processing system as claimed in claim 1 further comprising second signal blending means for blending the expanded audio signal with the received audio signal.

11. An audio signal processing system as claimed in claim 10 in which said output means is coupled to said expandor to provide the expanded audio signal as the processed output signal; said system further comprising second output means connected to said second signal blending means for providing a blended output signal from said system.

12. An audio signal processing system as claimed in claim 11 further comprising third output means coupled to said input means for providing the received audio signal as a third output signal from said system.

* * * * *